US005317780A

United States Patent [19]

Hobgood

[11] Patent Number: 5,317,780

[45] Date of Patent: Jun. 7, 1994

[54] BLASTING AND FILTRATION SYSTEM FOR USE WITH OIL WELL DRILL PIPE

[76] Inventor: J. Paul Hobgood, Station 2, Box 673, Houma, La. 70360

[21] Appl. No.: 649,009

[22] Filed: Jan. 31, 1991

[51] Int. Cl.[5] ..... B08B 9/02

[52] U.S. Cl. ..... 15/302; 15/104.04; 15/409

[58] Field of Search ..... 15/104.04, 104.05, 409, 15/302

[56] References Cited

U.S. PATENT DOCUMENTS

| | | | |
|---|---|---|---|
| 3,452,751 | 7/1969 | Austin | 15/409 X |
| 3,457,583 | 7/1969 | Renner | 15/409 X |
| 4,467,489 | 8/1984 | Begneand | 15/104.04 X |
| 4,530,131 | 7/1985 | Zell et al. | 15/321 |
| 4,616,377 | 10/1986 | Urbani | 15/302 |
| 4,862,551 | 9/1989 | Martinez et al. | 15/321 |
| 5,041,165 | 8/1991 | Urbani | 15/302 X |

*Primary Examiner*—Chris K. Moore

*Attorney, Agent, or Firm*—Pravel, Hewitt, Kimball & Krieger

[57] ABSTRACT

An oil well drill pipe thread cleaning system uses mechanical brushes to clean the drill pipe, and a closed loop cleaning fluid system for continuously washing the drill pipe and the cleaning threads with solvent, an eductor is used to continuously suction dirty cleaning fluid from the drill pipe, and a source of compressed air powers the eductor, and the mechanical cleaner.

10 Claims, 1 Drawing Sheet

BLASTING AND FILTRATION SYSTEM FOR USE WITH OIL WELL DRILL PIPE

BACKGROUND OF THE INVENTION

1. Field Of The Invention

The present invention relates to oil well drill pipe cleaning and more particularly relates to an improved method and apparatus for the cleaning of oil well drill, pipe threads wherein an improved solvent based cleaning and filtration system features a continuous closed loop flow system that continuously filters hydrocarbons, scale, rust and the like from the solvent, as generated during the mechanical cleaning of the drill pipe threads.

2. General Background

In the drilling of oil wells, a plurality of lengths of drill pipe are connected end to end and slowly extended down into the earth forming what is called in the industry a drill string. Drill strings can be thousands of feet in length and typically are lengths of cylindrical pipe having an open ended bore which is also cylindrical. At the ends of these lengths of pipe there are provided threads which include external threads on one joint and a corresponding connecting portion on the next joint which includes internal threads. These threaded end portions of drill pipe are often referred to as "pin" and "box" end portions.

The cleaning of drill pipe must be done on a regular basis because the environment of oil well drilling subjects the drill pipe to accumulations of drilling mud, soil and other formation material, rust, scale and the like.

One prior art method of cleaning drill pipe is through the use of an abrasive rotary wire brush machine which is powered by a rotary device such as an air powered drill. A shroud has been used to encapsulate the end of the drill pipe so that the removed scale, rust, dirt, drilling mud, hydrocarbons and the like are captured by the shroud and so that the material that is removed from the drill pipe does not pose a threat to the operator of the power tool which is used to remove the drill pipe. The shroud simply catches scale, rust and the like and prevents that material from flying through the air and hitting the operator in the eyes or face.

The use of a solvent increases the effectiveness of the mechanical action of the wire brush, but generates significant particulate matter including rust, scale, tar, drilling mud and the like which renders the solvent dirty and less effective as well as a pollution problem requiring disposal.

SUMMARY OF THE PRESENT INVENTION

The present invention provides an improved oil well drill pipe thread cleaning system wherein a common air supply is used to power a driver tool that mechanically removes scale, rust and like accumulations from the drill pipe threads. The air supply also communicates with an accumulator having flowlines discharging therefrom to provide power for transmitting cleaning fluid to a housing with brushes that cleans the drill pipe as the brushes are rotated by the power tool.

An air flowline communicates with a suction device, preferably in the form of an eductor that receives an influent suction line from the rotor housing via a drain line, the eductor having a discharge that communicates with a filtration unit. The filtration unit is partially driven by an air supply from the air supply unit and/or accumulator.

A filter discharge line communicates between the filter unit and a sump or holding tank for containing the cleaning fluid so that it can be reused in the cleaning operation. The entire system thus provides a closed loop flow of cleaning fluid between the sump or holding tank, and the accumulator for supplying air pressure to drive the cleaning fluid, the rotor housing wherein the cleaning fluid is added to the cleaning operation in combination with mechanically driven brushes, a discharge or drain line wherein the cleaning fluid is transmitted to an eductor wherein the dirty cleaning fluid is discharged under pressure to a filter unit.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figures 1, 2:
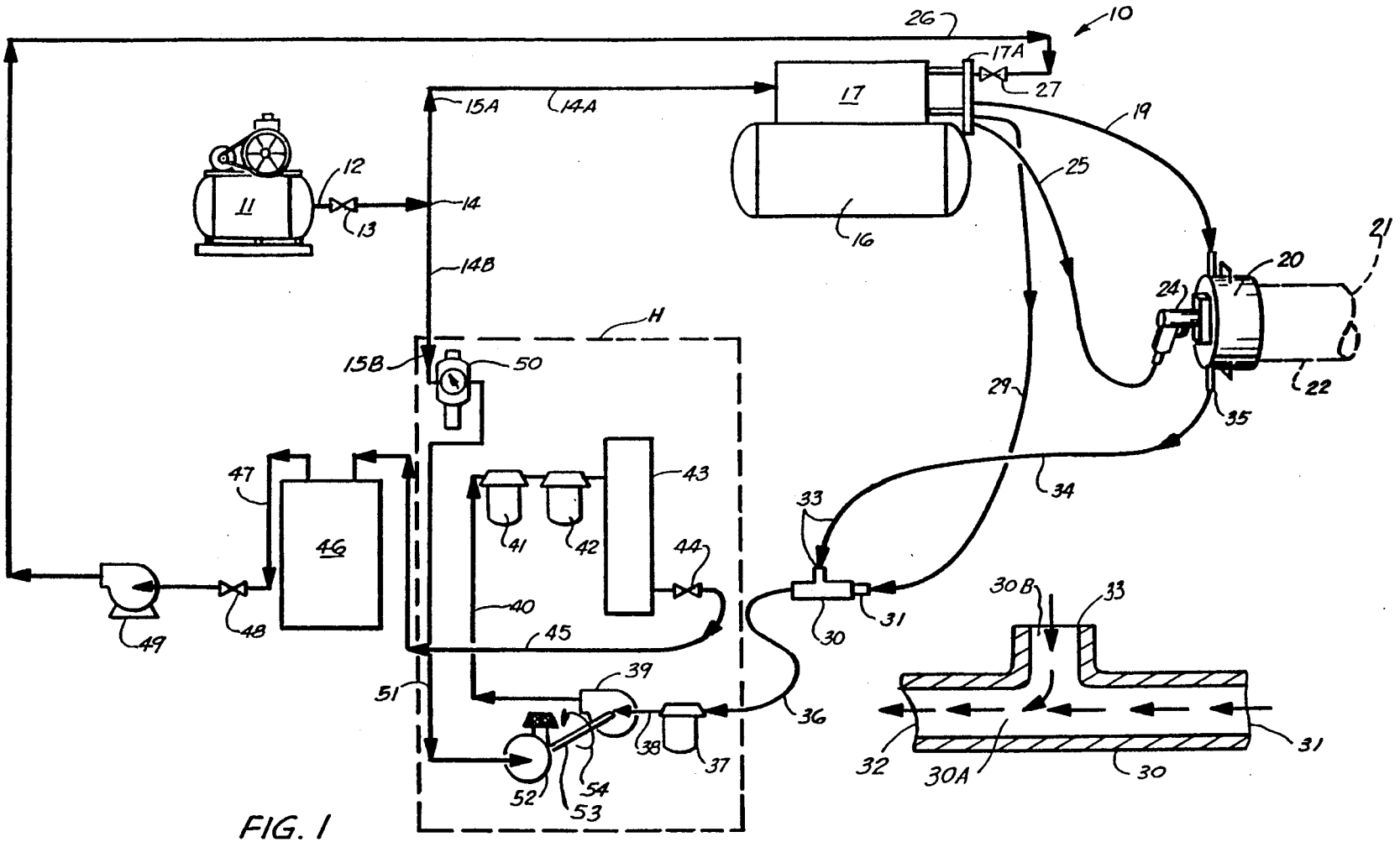
FIG. 1 is an overall schematic diagram of the preferred embodiment of the apparatus of the present invention.
FIG. 2 is a fragmentary view of the preferred embodiment of the apparatus of the present invention illustrating fluid flow through the eductor.

FIG. 1 illustrates the preferred embodiment of the apparatus of the present invention designated generally by the numeral 10. In FIG. 1, there can be seen thread cleaning system 10 as including a conventional air compressor 11 which discharges compressed air via line 12 to flowline 14 after passing through valve 13. Line 14 forms a tee connection with the flowline 12 and includes a first portion 14A and a second portion 14B with the direction of flow being indicated by the arrows 15A, 15B respectively.

An accumulator 16 receives pressurized air flow via line 14A. The accumulator includes a manifold portion 17 that receives pressurized air that is used to drive flowing cleaning fluid to the rotor housing 20.

Rotor housing 20 is a commercially available cover 20 includes drill 24 and cleaning brushes (not shown) that forms a cylindrical cover over the end portion 22 of drill pipe 21, and more particularly the threaded end portion which is to be mechanically cleaned. It is known in the art to use the housing 20, drill 24 and threads with a solvent to clean the end of drill pipe 22 at the threads. A power source such as pneumatic drill 24 receives air flow via line 25 from accumulator 16 and manifold 17 so that the drill 24 can rotate a plurality of brushes (not shown) that mechanically scrape undesirable material from the surface of the threads at the end 22 of a drill pipe section 21.

The brushes of drill 24 can be configured to clean either the internal threaded portion or the external threaded portion of an end of a section of drill pipe 21. It should be understood that the entire rotor housing with brushes and drill is a commercially available product which includes the drill 24, the shroud or rotor housing 20 and the internal brushes (not shown) which mechanically clean and scrape either the internal threads or the external threads at an end portion 22 of a section of drill pipe 21.

Cleaning fluid is supplied to the shroud or rotor housing 20 via line 19. The manifold 17 includes a valved manifold section 17A that allows air flow under pressure to be used to power drill 24 via line 25, and to pump cleaning fluid received into manifold section 17A via flowline 26 that passes through valve 27. The manifold section 17A thus can provide fluid flow between the flowline 26 and the flowline 19 with pressure being added to that flowline at manifold 17A as supplied to the Airflow leaves manifold section 17A via flowline 29 and is transmitted via line 29 to eductor 30. The eductor 30 includes an inlet 31, an outlet 32, and a cleaning fluid influent 33. The influent 33 receives dirty cleaning fluid via line 34 which exits the outlet 35 of rotor housing 20. The dirty cleaning fluid contained in line 34 will include the cleaning fluid which is a commercially available solvent, as well as dirt, rust, scale, hydrocarbons, and/or drilling mud. Compressed air enters eductor at inlet 31 via flowline 29 from manifold section 17A.

Compressed air 31 passes through the eductor 30 (FIG. 2) which includes a central longitudinally extending open ended bore 30A between end portions 31 and 32, which communicates respectively with influent flowline 29 and effluent flowline 32. Intersecting the central longitudinal bore 30A at a lateral direction with resect thereto is a lateral bore 30B that communicates with influent liine 33 so that fast flowing compressed air flowing through the eductor 30 in bore 30A between inlet 31 and outlet 32 suctions cleaning solvent at transverse bore 30B and flowing in line 34. In this manner, the flowline 34 basically acts as a suction line for continuously removing any cleaning fluid from rotor housing 20 which enters the housing 20 via influent cleaning line 19.

Effluent cleaning fluid under pressure exits eductor 30 via line 36 and enters filter 37 which removes preliminary heavy waste material. The cleaning fluid then leaves filter 37 via line 38 wherein fluid flow velocity is maintained by air driven pump 39 through the filtration system, fluid exiting pump 39 to line 40 wherein filters 41, 42 sequentially remove further waste material from the flowline carrying dirty cleaning fluid. A fine filter vertical column 43 removes the remainder of waste material from the dirty cleaning fluid and effluent line 45 downstream of valve 44 carries regenerated material that is discharged from filter column 43 to sump 46. The filtration system including filters 37, 41, 42, 43; the pump 39, air motor 52, shaft 53, and valve 44 are preferably contained in a self-contained, transportable sealable housing or cabinet H.

Sump 46 receives the regenerated cleaning fluid from filter 43 and that regenerated cleaning fluid is reused in the closed loop flow system 10, being discharged via line 47, passing through valve 48, and being transmitted through pump 49 to flowline 26 for reuse in the system. A pressure reading at 50 is an optional feature. Pump 39 can optionally be driven by fluid power from line 51 used to drive turbine or air motor 52 rotating drive shaft 53 in a rotary direction as shown by arrow 54. Pressure vents, relief valves or the like can be used if desired to control pressure at locations within the closed loop flowline system such as, for example, at sump 46 or at fine filter column 43.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as the invention is:

1. A drill pipe thread cleaning system comprising:

a) a source of flowing cleaning fluid solvent for cleaning the drill pipe threads and contained in a closed loop flowline system;

b) thread cleaning means including a rotary brush for mechanically cleaning the drill pipe threads, and a shroud for encapsulating the end of the drill pipe during mechanical cleaning of the threads, the shroud including a solvent influent and a solvent effluent portion for receiving and discharging respectively cleaning fluid solvent from the shroud;

c) an eductor for receiving a dirty cleaning fluid solvent stream from the shroud, the eductor including a first longitudinally extending open ended bore adapted to receive compressed airflow therethrough and a transverse bore that communicates with the longitudinal bore and forming a portion of the closed loop for communicating cleaning fluid between the shroud and the eductor;

d) a filtration system disposed in the closed loop flowline downstream of the eductor and including a plurality of filters sequentially positioned in the closed loop flowline for removing contaminants from the cleaning fluid solvent, the closed loop flowline system including sump means for accumulating cleaning fluid solvent downstream of the filtration system;

e) a source of compressed air for introducing compressed air to the closed loop flowline system;

f) the source of compressed air including an accumulator communicating with the closed loop flowline system for containing a volume of compressed air;

g) manifold means that includes multiple flowlines, for dispensing compressed air to the brush cleaning means and to the eductor means for powering the brush and for thrusting compressed air through the eductor means;

h) air driven pump means positioned in the closed loop flowline between two of the plurality of filters so that the pump suction line receives filtered solvent; and i) the pump being powered by the source of compressed air.

2. The system of claim 1 further comprising a branched flowline transmitting compressed air from the source of compression to the manifold means and to the air driven pump means.

3. The system of claim 4 wherein the air driven pump, and the filtration means are contained in a sealed housing.

4. The system of claim 1 wherein the closed flowline system comprises a sump for holding a volume of cleaning fluid, a first flowline extending between the sump and the manifold means, a second flowline extending between the manifold means and the thread cleaning means, a third flowline defining a dirty cleaning fluid discharge line extending between the thread cleaning means and the eductor, and a fourth flowline extending from the eductor and the sump.

5. The system of claim 1 wherein the multiple sequenced filters are positioned sequentially in the fourth flowline to receive flow from the eductor.

6. The system of claim 5 wherein the plurality of filters includes a first coarse particulate filter, a second particulate filter, and a third fine particulate filter.

7. The system of claim 6 wherein the air driven pump means is positioned between the first coarse particulate filter and the second particulate filter.

8. The system of claim 6 wherein the fine particulate filter is a vertical filter column having solvent inlet at its upper end portion and a solvent outlet at its lower end portion.

9. The system of claim 4 further comprising pump means for transmitting fluid under pressure between the sump and the manifold means.

10. The system of claim 1 wherein the filtration means is contained within a housing.

* * * * *